US005152087A

United States Patent [19]

Maguina-Larco

[11] Patent Number: 5,152,087

[45] Date of Patent: * Oct. 6, 1992

[54] HOLDING CLAMP AND REVERSIBLE EARTH WORKING CUTTING TEETH

[75] Inventor: Alfredo Maguina-Larco, Lima, Peru

[73] Assignee: A. M. Logistic Corporation, Woodbridge, Va.

[ * ] Notice: The portion of the term of this patent subsequent to Jul. 2, 2008 has been disclaimed.

[21] Appl. No.: 633,515

[22] Filed: Dec. 31, 1990

Related U.S. Application Data

[63] Continuation-in-part of Ser. No. 594,545, Oct. 9, 1990, Pat. No. 5,027,535.

[51] Int. Cl.[5] ..... E02F 9/28

[52] U.S. Cl. ..... 37/141 T; 37/142 R; 299/91

[58] Field of Search ..... 37/142 A, 142 R, 141 T, 37/141 R; 299/91, 92, 93

[56] References Cited

U.S. PATENT DOCUMENTS

| | | | |
|---|---|---|---|
| D. 275,757 | 10/1984 | Nja . | |
| 457,047 | 8/1891 | Green . | |
| 1,058,841 | 4/1913 | Boyd . | |
| 2,950,096 | 8/1960 | Krekeler et al. | 299/93 |
| 3,342,531 | 9/1967 | Krekeler | 37/142 A X |
| 3,576,082 | 4/1971 | Lowrey . | |
| 3,678,605 | 7/1972 | Prime | 37/142 A X |
| 3,729,845 | 5/1973 | Flippin | 37/142 A |
| 3,755,933 | 12/1971 | Lowrey . | |
| 4,335,532 | 6/1982 | Hahn et al. | 37/142 R |
| 4,391,050 | 7/1983 | Smith et al. | 37/142 A |
| 5,027,535 | 7/1991 | Maguiña-Larco | 37/142 R X |

*Primary Examiner*—Dennis L. Taylor
*Assistant Examiner*—J. Russell McBee
*Attorney, Agent, or Firm*—Cushman, Darby & Cushman

[57] ABSTRACT

A boltless U-shaped holding clamp providing resilient clamping force and a reversible cutting tooth made from solid, hardened bar stock material. The clamp has a snout receiving channel for wedgedly engaging locking grooves of a digging member shank, and a tooth receiving channel of constant transverse cross section for receiving the hardened reversible tooth, also of constant transverse cross section. The bar stock tooth includes beveled cuts at each end which mate with an inclined stopper wall in the rear of the tooth receiving channel of the clamp when the tooth is inserted therein. Axial forces on the tooth during excavation or digging operations drive the clamp into greater frictional engagement thereby to achieve self-tightening. Self-tightening is facilitated by differential friction at the respective clamp-tooth and tooth-shank interfaces such that axial forces on the tooth act first to drive the clamp upon the snout to increase the wedging grip rather than permitting the tooth to slide against the shank through the receiving channel of the clamp. The clamp body also has a certain modulus of elasticity to provide the resilient clamping force so as to absorb impact and vibrational forces. A worn tooth may be reversed or extended thereby providing greater consumption of the expensive tooth material. Protector or spacer blocks are provided in the tooth receiving channel to extend a worn tooth for greater consumption thereof.

18 Claims, 8 Drawing Sheets

HOLDING CLAMP AND REVERSIBLE EARTH WORKING CUTTING TEETH

CROSS-REFERENCE TO RELATED PATENTS AND APPLICATIONS

This invention is a continuation-in-part of allowed, commonly-owned U.S. patent application Ser. No. 594,545 filed Oct. 9, 1990 titled "Boltless Holding Clamp For Earth Working Cutting Teeth" by the same inventor hereof (now U.S. Pat. No. 5,027,535).

This invention is related to the subject matter of commonly-owned U.S. Pat. No. 4,899,830 titled "Cutting Tooth Assembly For Earth Working Machines" issued Feb. 13, 1990 to the same inventor hereof, which is incorporated herein by reference.

This invention is further related to commonly-owned U.S. patent application Ser. No. 07/629,814, filed Dec. 21, 1990 titled "Adaptor For Earth Working Cutting Tooth and Clamps" by the same inventor hereof.

FIELD OF THE INVENTION

This invention pertains to a reversible cutting tooth and a holding clamp for wedgedly securing the reversible tooth at adjustable positions on a digging or cutting member of earth working equipment, such as the shank of an earth moving machine, an agricultural machine, mining equipment, or a machine generally used in the construction and mining industries. Typical machines include bulldozers, scarifiers, rippers, excavators, backdiggers, power shovels and rotary cutting machines.

BACKGROUND OF THE INVENTION

An earth working machine typically utilizes a digging or cutting member which employs a plurality of shanks to which teeth are attached by a variety of means including welding, bolting, and wedge-fitting. It has been recognized that fastening provided by the combination of a holding clamp and tooth provides certain advantages over a sole boltless tooth fastened directly to a shank. These advantages stem from conflicting physical requirements of the cutting teeth and the holding mechanism. The cutting point of the tooth must be formed of a hard wear-resistant material while the holding mechanism usually requires a material of at least some elasticity and/or ductility. A sole boltless tooth cannot adequately fulfill both requirements.

As widely practiced in the art, a current boltless digging tooth connects to the snout of a shank by a wedging force between shank grooves and a receiving channel formed at one end of the tooth. Such an arrangement permits quick hammer-driven changing of worn teeth, as shown, for example, in U.S. Pat. No. 2,222,071 issued to Gustafson. The availability of rapid changing reduces costly down time, thereby permitting more economical operation of the equipment. A wedge coupling mechanism, however, requires a material having defined stress-strain characteristics, e.g., a certain amount of ductility or elasticity in the snout receiving channel of the tooth in order to permit adequate wedging engagement and resilient clamping force between the tooth and the shank to absorb impact forces under working load conditions, or to provide adequate clamping under conditions where centrifugal forces act to loosen the tooth. On the other hand, the cutting point of the tooth mandates use of an extremely hard wear-resistant material having de minimis flexural properties. Consequently, conventional boltless teeth must either be manufactured in two stages to achieve the opposing requirements of the cutting point and snout receiving channel of the tooth, which renders them expensive. Alternatively, if the tooth is made in one operational stage, the hardness-ductility parameters of the snout receiving channel and cutting point must be compromised, in which case the tooth quickly wears out, thus leading to more costly down time and tooth replacement cycles.

As also known, the cutting or digging member of an earth working machine is subjected to severe impact and abrasive forces. It very often happens that the tooth attachment system is also subjected to those same forces which impose mechanical deformations upon the attachment system. Such deformations, in turn, interpose difficulties in changing or adjusting worn cutting teeth thereby causing more costly down time. Moreover, impact forces induce vibrations which tend to loosen threaded fasteners.

It is also highly desireable to provide a holding clamp adapted for use with an "adjustable" cutting tooth so that a tooth having a worn tip might be quickly extended and refastened to the shank of the digging member. By adjustable, it is meant that the tooth may be loosened in the holding assembly, axially extended forward of the digging member of the earth working machine, and then refastened to the shank by the holding clamp. Provision of rapid adjustment provides substantial economic benefits in reduced machine down time and reduced teeth replacement costs since a substantial portion of the expensive tooth material may be consumed, rather than discarded. A tooth holding clamp utilizing fasteners such as bolts, dowel pins, screws or the like, such as shown by U.S. Pat. No. 3,750,761 to Smith et al., although adaptable for use with adjustable cutting teeth, suffers not only from the laborious slow-pace tooth changing or adjustment process, but also from mechanical deformation and loosening of the fastener heads occurring during digging or cutting operations.

U.S. Pat. No. 2,940,192 to Lattner and U.S. Pat. No. 4,576,239 to Launder show non-adjustable teeth-holding clamps which suffer, inter alia, from the lack of adjustability of the clamped position the cutting tooth relative to the shank, and thus will impose significant operating costs on the end user. Not only are their cutting teeth non-adjustable, which requires the discarding of a substantial amount of specially treated and formed hard wear-resistant material of the teeth, but their teeth have relatively complex physical dimensions which add to their cost of manufacture since they cannot be conveniently fabricated from readily available bar stock material. In addition, the holding force provided by Lattner's clamp may be inadequate under certain extreme load conditions since the wedging force is partly divided between the lateral and vertical directions viewing a cross-section of the tooth and clamp from an axial direction. Lateral clamping forces do little to aid frictional holding between the tooth and the shank under impact loads. Further, the respective surface areas of shank-tooth and tooth-clamp frictional contact in an x-z plane may be inadequate to offset certain levels of impact forces encountered in the z-direction in relation to the width of Lattner's tooth. In addition, Lattner's tooth may not adequately drive the clamp into greater clamping engagement during installation of the tooth.

Launder, on the other hand, may also suffer the same drawbacks, particularly since the surface area of frictional contact is limited to mated clamp-to-tooth curvilinear contact (which diminishes tooth-to-shank frictional holding for a given clamp-to-shank wedging force), and a relatively wide gap exists between the tooth and clamp side walls which seemingly permits lateral instability of the tooth in the x-direction during impact loads. Launder, in fact, teaches away from tooth-to-clamp side wall contact in order to attain ease in alignment, and apparently, is intended to permit separation of the clamp-tooth assembly. Above all, Launder's tooth does not self-tighten in response to axial loads applied to the tooth and cannot be positionally adjusted since there is no clearance in the z-direction between the length of the clamp receiving channel, on one hand, and the distance between the lateral ear projections and the stopwall of the tooth, on the other hand. In addition, Launder has little or no means for providing resiliency in the clamping force.

Furthermore, it is likewise desireable to provide an abrasive-resistant reversible cutting tooth of bar stock material having no perforations (bolt holes) in the body thereof, as well as, a holding clamp adapted to reversibly receive the cutting tooth in order to extend the useful life of the tooth. Such an arrangement reduces tooth breakage and machine down time. Reversible cutting teeth per se are known, such as those disclosed by U.S. Pat. No. 457,047 to Green; U.S. Pat. No. 1,058,841 to Boyd; U.S. Pat. Nos. 3,576,082 and 3,755,933 to Lowrey, and Des. Patent 275,757 to Nja. However, none of these prior reversible cutting teeth are designed for use with a boltless, wedge-tightened holding clamp of the present invention which self-tightens upon the application of axial loading forces to the teeth. In addition, prior reversible teeth are prone to fatigue failure due to perforations or bolt holes generally located at their midsection. Such holes are necessary for prior reversible teeth since they are not designed for boltless connection. Unfortunately, these bolt holes yield undesirable weak points and localized stresses thereby tending to engender and propagate fatigue cracks in and about any inclusions in the body of the tooth which result in its ultimate failure during impact loads. Moreover, hardened cutting teeth having a desireable Brinell Hardness exceeding 400 are virtually impossible to machine to make perforations thus making a boltless clamping system for reversible teeth a practical necessity. These requirements suggest that hardened teeth are virtually unadaptable to prior reversible teeth systems.

In view of the foregoing, the present invention has as its objective a primary purpose to overcome the foregoing drawbacks of prior holding clamps and reversible teeth. In brief summary, the objectives of the present invention include providing a holding clamp which permits the use of bar stock material of constant cross section to form a reversible cutting tooth of a hard wear-resistant material, providing means for positionally adjusting the clamped position of the cutting tooth on a shank of an earth working digging or cutting member, providing a holding clamp of a material having a given stress-strain characteristic which provides a modulus of elasticity necessary to maintain clamp-to-shank wedging forces and for absorbing forces impacted upon the tooth during digging or cutting operations, providing a holding clamp which enables quick connecting and disconnecting of a tooth in order to reduce equipment down time, providing a holding clamp which acts to self-tighten the wedging force upon impact loads applied to the tooth during digging and/or cutting operations, providing a holding clamp and reversible tooth which requires no bolts or threaded fasteners, thereby obviating fatigue failure and adjusting difficulties due to deformations of the tooth fastening system, providing a holding clamp which is readily adapted to couple shanks and locking grooves used in the construction, agricultural and mining equipment, providing a holding clamp which provides maximum restraint against tooth movement in the x-, y- and z- directions during cutting and digging operations when engaged in clamping relation, providing a holding clamp to provide maximum force translation between clamp-to-shank wedging action and tooth-to-shank frictional holding force, providing a holding clamp having sufficient clamp-to-tooth contact force to offset extreme loading along the z-axis for holding the constant cross section portion of the tooth in the receiving channel of the clamp, and providing a boltless and reversible cutting tooth comprising a solid wear-resistant material and a corresponding holding clamp adapted to receive the reversible cutting tooth.

SUMMARY OF THE INVENTION

In accordance with the present invention, a boltless holding clamp comprises a generally U-shaped body of a material having a given stress-strain characteristic, said clamp body including a pair of appending flanges having wedge means for engaging locking grooves of a digging member shank of an earth working machine, said appending flanges further defining a snout channel means for receiving said shank member, said clamp body including a tooth receiving channel of uniform cross section for supporting the portion of the reversible tooth having a uniform cross section in frictional contact with said shank member, said flanges and said receiving channels being adapted to translate substantially all of the shank-to-flange wedging force to a clamp-to-tooth and a tooth-to-shank frictional contact force, said given stress-strain characteristic of said clamp body of material providing means to maintain sufficient frictional holding force against said tooth and for absorbing impact forces encountered by the tooth during digging operations, and said holding clamp having complementary stopper wall means in the tooth receiving channel for engaging a complementary surface of the cutting point of said reversible cutting tooth.

Another aspect of the invention includes a boltless and reversible cutting tooth having cutting points at each end thereof and being adapted for use with the aforestated holding clamp wherein the cutting tooth comprises a solid body of hardened wear-resistant material of constant cross section complementary to the cross section of the tooth receiving channel.

In another aspect of the invention, a protector block means is provided for insertion into the tooth receiving channel of the holding clamp in order to provide means for protecting the stopper wall upon insertion of overly worn teeth and for extending forwardly a shortened worn cutting tooth relative to the holding clamp wherein the protector block means has one end complementary to the shape of the stopper wall means. Such protector block means also provides additional means for utilizing a greater portion of the cutting tooth material.

In yet another aspect of the invention, the clamp-to-tooth fractional contact force exceeds the tooth-to-shank frictional contact force which, in turn, enables increased shank-to-clamp wedging engagement during operation when the tooth is axially driven by impact forces that further drive the clamp upon the shank member. Such differential frictional holding forces acting on the respective top and bottom surfaces of the tooth is particularly advantageous when employing a tooth of constant transverse cross section since otherwise, the tooth may be more apt to slide along the shank when impacted. The differential friction enables the tooth to be fixedly positioned at adjustable positions along the shank relative to the holding clamp by an extreme self-acting clamping force which develops in response to impact loads.

Axial forces encountered during digging or cutting operations act to fasten the tooth securely to the shank. Thus, these forces can actually provide a self-tightening effect by driving the cutting tooth along with the holding clamp further into wedging and frictional engagement, with the holding clamp effectively preventing any loosening of the assembly by virtue of its shape and stress-strain characteristic.

In some applications, such as machines with rotational cutting drums, there are also present vibrational and centrifugal forces acting in a direction opposite to those required for securing the tooth, which result in loosening. To reduce the likelihood of loosening, stops are attached to the tooth which abut the forward portion of the clamp thereby to force the clamp further into the frictional wedging grip with the main shank member during use of the cutting tooth.

For applications involving extremely high vibration levels, the stopper wall in the aft portion of the holding clamp receiving channel provides an abutment for the cutting tooth, preventing aft movement of the tooth relative to the holding clamp when subjected to axial forces. These forces drive the cutting tooth along with the clamp into further wedging engagement, thus effectively preventing any loosening of the tooth-clamp-shank assembly.

Advantageously, the tooth is easily changed or adjusted. When the tooth is worn, the clamp is loosened by hammer taps in the forward direction, the tooth is then positionally adjusted in the forward direction, and then the clamp is again engaged by hammer taps in the aft direction. Alternatively, the tooth may be reversed or replaced altogether. This sequence permits all but a minor length of the cutting tooth to be successively used.

Other aspects, features and advantages of the present invention will become more readily apparent upon review of the following description taken in connection with the accompanying drawings, all of which form part of this specification, wherein like reference numerals designate corresponding parts in the various figures.

DESCRIPTION OF ILLUSTRATIVE EMBODIMENTS

Figure 1:
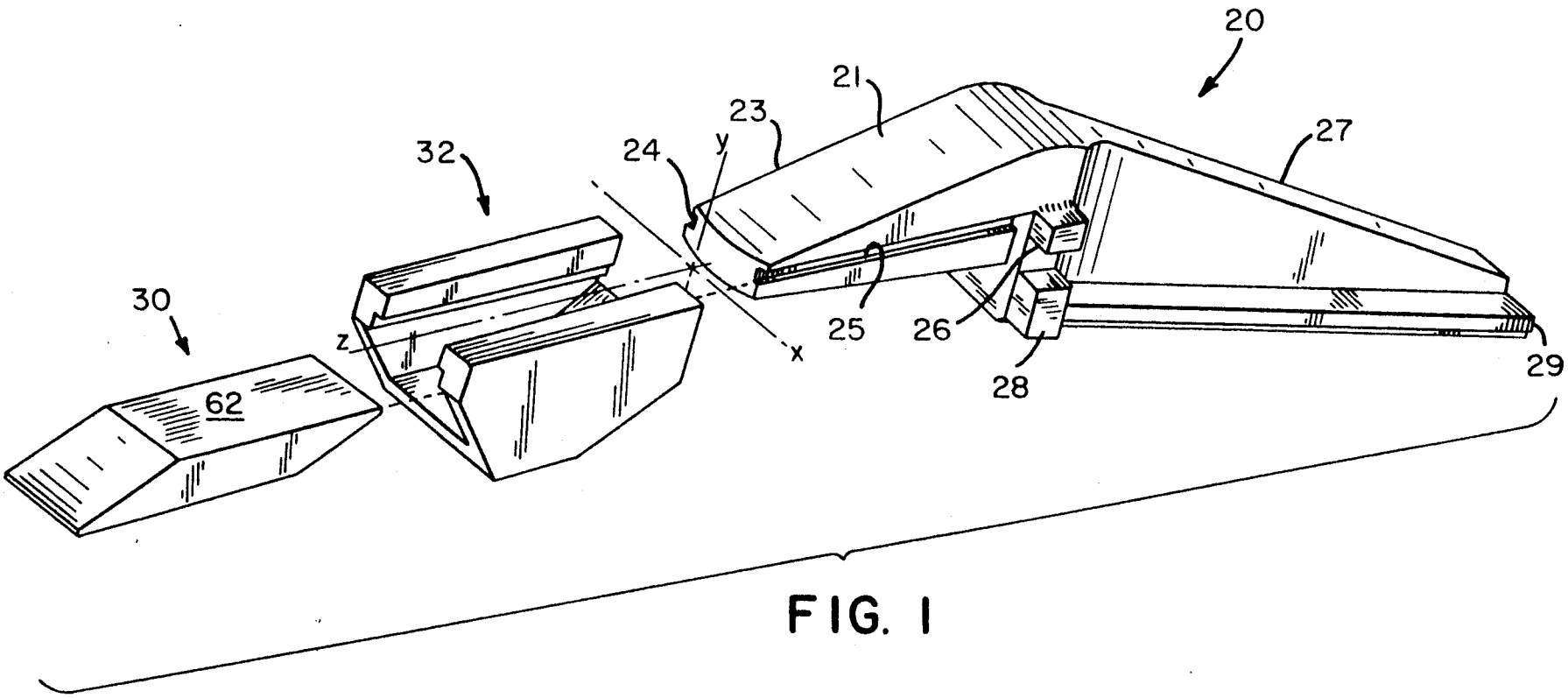
FIG. 1 is an exploded perspective view of a shank member, a holding clamp, and reversible and adjustable cutting tooth of the present invention.
Figure 2:
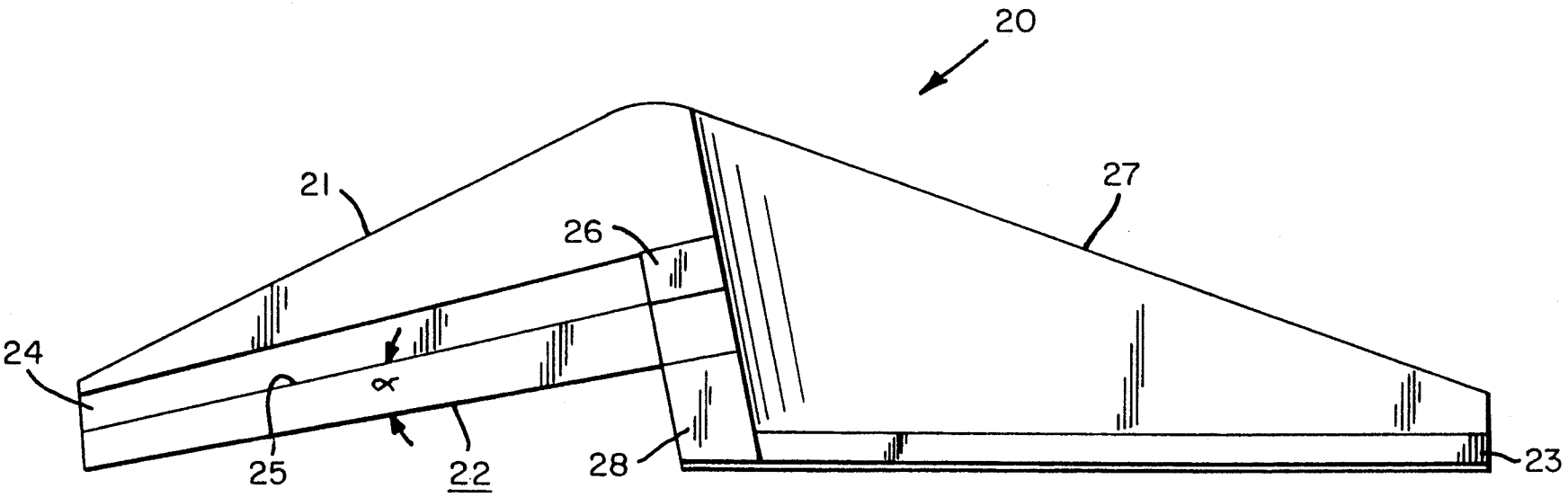
FIG. 2 depicts a side elevational view of the shank member shown in FIG. 1.
Figure 7:
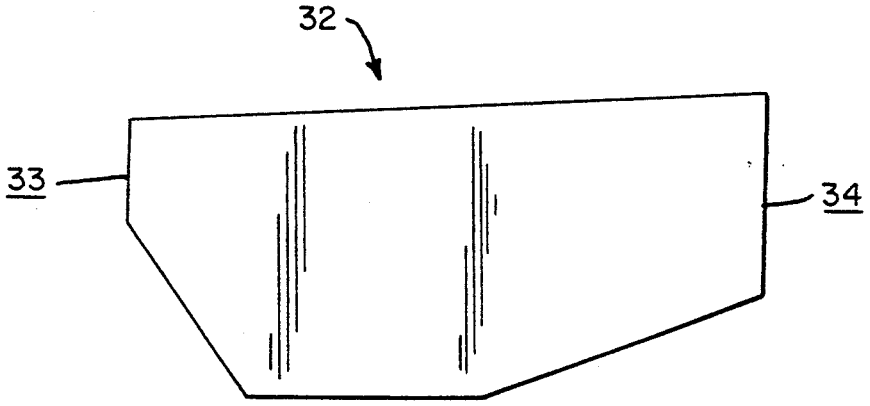
FIG. 7 is a side elevational view of the holding clamp shown in FIG. 4.

FIG. 1 herein depicts an exploded view of a shank member 20, a generally U-shaped holding clamp 32 and a reversible and adjustable cutting tooth 30. As noted, the cutting tooth 30 advantageously comprises a solid piece of bar stock material having no bolt holes or perforations, and therefore, is less susceptible to fatigue failure, as previously mentioned. The shank 20, more particularly shown in FIG. 2, is formed of a very hard steel and includes a wide flange 29 which is connected to a digging or cutting member of the earth working machine (not shown) by dowels, welding, bolting or by other convenient means, as is conventional in the art. The shank 20 also includes clamp guards 26 and 28 connected to each side thereof. These clamp guards protect the holding clamp from loosening during back-up movements of the digging member by pushing away earth material from the path of the holding clamp thus preventing reverse strikes on the rear surface 34 (FIG. 7) of the clamp.

In addition, the shank 20 is formed with a steel web 27 for supporting both the flange 29 and the snout 21. As noted, in accordance with one aspect of the invention, the thickness of the steel web 27 is less than the width of the snout and the tooth in order to reduce contact wear with the soil. The tooth, clamp and/or snout cut swaths for the web 27 thus reducing its wear.

Figure 3:
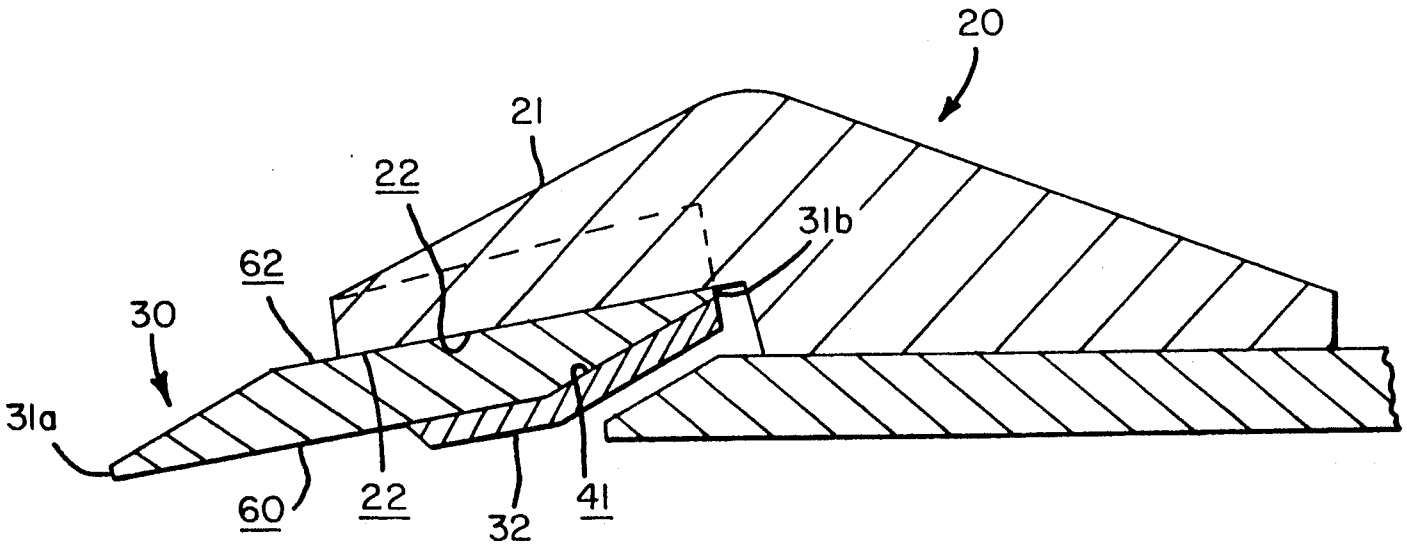
FIG. 3 is a cross-section along the longitudinal axis of the shank, holding clamp and tooth of FIG. 1 in assembled relation.

Still referring to FIG. 2, the shank 20 carries a planar surface 22 on the snout 21, a pair of locking grooves 24 on each side of the shank, and a pair of inclined wedge-locking bearing surfaces 25 facing inwardly of the grooves 24. FIG. 3 depicts the planar surface 22 bearing against an upper surface 62 of the cutting tooth 30 as they lie in assembled relationship when in frictional contact. When inserted in the tooth receiving channel of the clamp, a beveled cutting edge 31*a* (or 31*b*) of the tooth lies in mating contact with a stopper wall 41 of the clamp to restrain the tooth at its fully inserted position. As subsequently explained, the stopper wall 41 enables impact forces to drive the boltless clamp into tighter engagement, particularly during vibrational loads.

The respective bearing surfaces 25 in the snout grooves 24 diverge from the surface of planar face 22 from the open end of the grooves, at a small angle $\alpha$ of, for example, 4°, more or less, as shown in FIG. 2. The angle $\alpha$ of divergence defines excursions of clamping force along the y-axis for given movements of the U-shaped clamp 32 along the z-axis. To attain more desireable force excursions in relation to clamp movement, the invention advantageously provides a holding clamp 32 being formed of a material having either or both a special structural configuration or a predetermined stress-strain characteristic, e.g., ductility and/or modulus of elasticity. Further, the snout surface 22 and the bearing surfaces 25 of locking grooves 24 are smooth surfaces providing for a relatively low friction coefficient.

The U-shaped holding clamp 32, more particularly shown in FIGS. 4–7, has a front end 33 which receives the tooth 30 in a tooth receiving channel of the clamp, and a rear end 34 which is adapted to be positioned upon the snout 21 via a snout receiving channel in the clamp. The tooth receiving channel guides the tooth during assembly and holds it when frictionally clamped. Further, the tooth receiving channel is defined by a clamping surface 40 of the clamp which bears against a surface 60 of the tooth (FIG. 3), respective side surfaces 38 of the clamp which slideably engage respective sides of the tooth 30, and guide surfaces 39 of the clamp which slideably engage respective portions of surface 62 of the tooth during assembly or positional adjustment. The tooth receiving channel is generally rectangular, also being of constant transverse cross section complementary to the constant transverse cross section of the tooth 30.

When place in clamping engagement, little or no contact is made between clamp guide surfaces 39 and tooth surface 62 (FIG. 3) since frictional contact is developed and maintained between mating clamp-tooth surface pairs 40–60 and mating shank-tooth surface pairs 22–62.

An inclined rearward surface 41 in the tooth receiving channel of the clamp provides an abutment that acts as a stopper wall which defines the rearward positional limit of the tooth 30 relative to the clamp 32 when inserted into the receiving channel. The stopper wall 41 is inclined to accommodate the beveled cutting points of the tooth near its respective cutting edges 31*a* and 31*b* (FIG. 3).

Respective legs 67 of the U-shaped clamp 32 include appending flanges 35 which longitudinally extend along the z-axis. These flanges 35 define the snout receiving channel in the clamp 32 for receiving the locking grooves 24 of the snout 21. This snout receiving channel is not of constant transverse cross section, but instead, includes inclined bearing surfaces 64 which are adapted to mate frictionally with bearing surfaces 25 of the snout locking grooves 24. With the tooth 30 inserted, the snout receiving channel is defined by the surface 62 of the inserted tooth, side walls 36 of the clamp, and bearing surfaces 64 of the flange, and guide surfaces 37 of the clamp. All but surfaces 64 in the clamp 32 are parallel to the z-axis.

The internal bearing surfaces 64 are inclined from the z-axis in the same direction and in approximately the same amount as inclined bearing surface 25 of the shank groove 24, e.g., approximately 4°. The surfaces 25 and 64 mate together when the clamp engages the snout. As previously noted, the extent of incline determines the y-axis force excursion in relation to z-axis movements of clamp 32 along the snout. However, these force excursions are improved by an aspect of the present invention in that the legs 67 provide some degree of resiliency, elasticity or ductility to absorb holding and vibrational forces encountered by the tooth during use, thereby to reduce loosening tendencies.

Still referring to FIGS. 4–7, surface 40 is preferably a friction surface and may be enhanced to provide a higher coefficient of friction. Enhancement allows surface 40 to better frictionally engage the tooth surface 60 (or 62 if reversed) and is highly desireable for providing the self-tightening feature of the present invention. As previously indicated, differential frictional properties exist between the clamp-to-tooth and the tooth-to-shank interfaces. The frictional contact force at the clamp-to-tooth interface is higher which is important in view of employment of a tooth of constant transverse cross section. The higher frictional contact force at the clamp-to-tooth interface facilitates driving the clamp into greater clamping engagement in response to application of impact loads to the tooth thereby to provide means to fixedly position the tooth at adjustable positions relative to the clamp along the shank. Otherwise, the constant cross-sectional tooth would have a greater tendency to slide longitudinally within the tooth receiving channel until abutting the stopper wall 41 in the rear of the clamp thus preventing the desired near-total consumption of the tooth material in accordance with this invention.

Differential frictional contact force may be attained by providing different frictional properties at the respective clamp-to-tooth and tooth-to-shank interfaces.

Clamp surfaces 39 have a low friction coefficient since they merely act to guide the tooth into the tooth receiving channel of the clamp during assembly and adjustment. Side surfaces 38 of the clamp also have relatively low friction coefficient since they essentially serve to prevent lateral displacement or angling of the cutting tooth 30 in the receiving channel.

Figure 4:
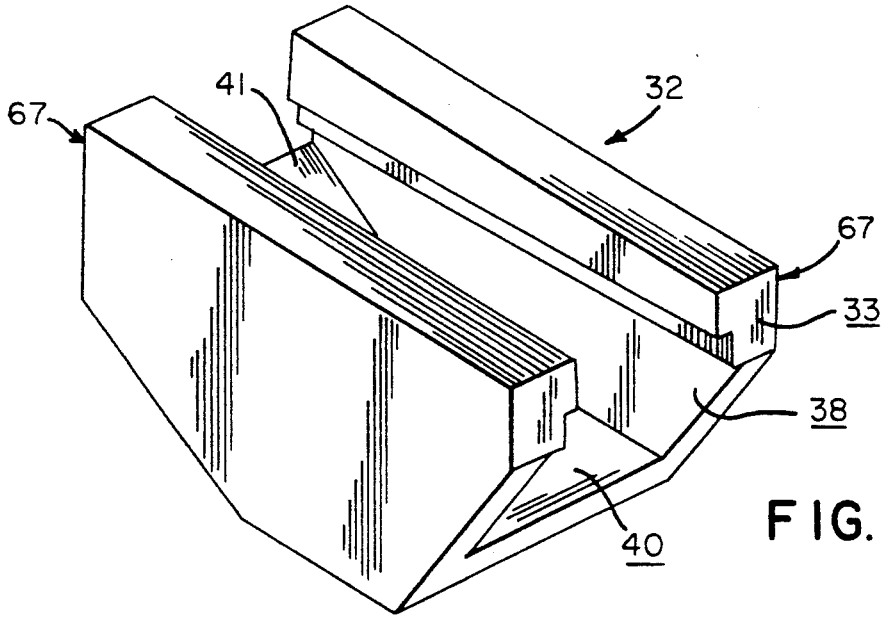
FIG. 4 is a perspective view of the holding clamp depicted in FIG. 1.
Figure 5:
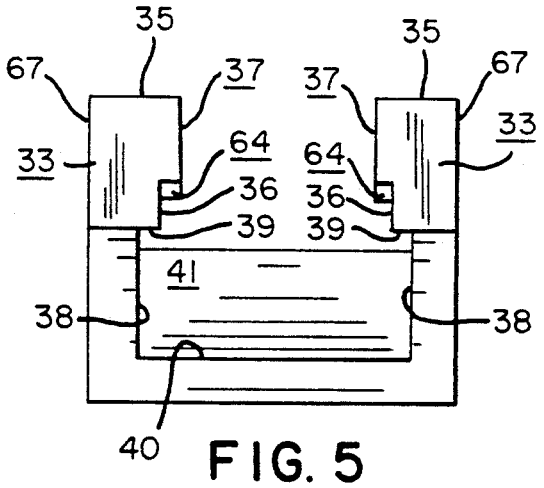
FIG. 5 is a front elevational view of the holding clamp shown in FIG. 4.
Figure 6:
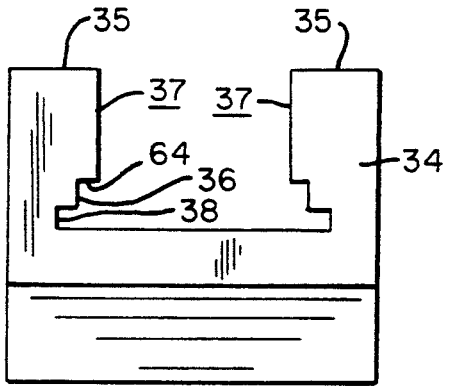
FIG. 6 is an aft elevational view of the holding clamp shown in FIG. 4.
Figure 8:
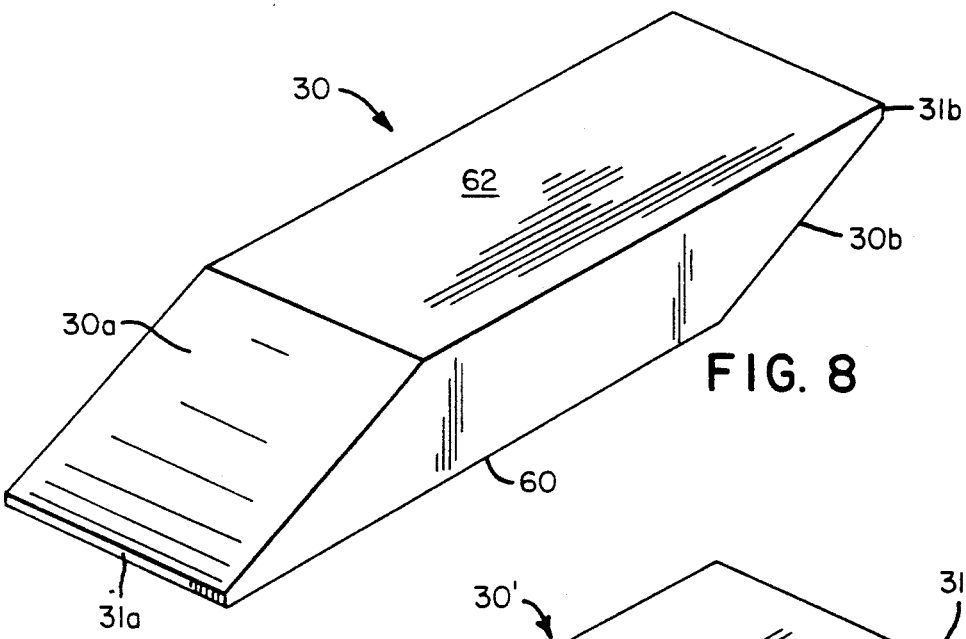
FIG. 8 is a perspective view of a reversible and adjustable cutting tooth for use with the holding clamp of the present invention.

As shown in FIG. 8, the cutting tooth 30 has forward and rear cutting edges 31*a* and 31*b*. The tooth is in the form of a standard flat bar of steel of constant transverse cross section having beveled cutting edges formed at each end. Rather than being beleled, the cutting points may take on a variety of other forms and shapes. The respective illustrated forward and rear beveled surfaces 30*a* and 30*b* are cut into the bar stock at the same incline as that of stopper wall 41 of clamp 32 (FIGS. 4–5). The beveled surfaces are substantially parallel to each other so that the tooth may be reversibly inserted into the receiving channel of clamp 32. As previously indicated, cutting tooth 30 has a first flat surface 60 which bears against the clamp surface 40 in clamping relation and a second flat surface 62 which bears against the flat snout surface 22 when in clamping relation. Mating contact is reversed when the tooth is reversed. Preferably, the steel tooth 30 is solid (no bore holes) and has a hardness of about 50–70 on the Rockwell C scale (or a Brinell Harness over 500) and a resistance to bending of about 200k PSI, or more, so that it can withstand the hard use to which it is to be subjected, and to resist wear and fatigue under the extremely high stresses imposed on the cutting tooth during use. Of course, these ranges may vary depending upon the desired application. Such hardness is not desireable for the clamp 32 for reasons discussed above.

The clamp 32 is preferably made of forged steel (or made by molding using investment or sand casting) and has a modulus of elasticity which facilitates absorption of holding force vibrations, thus providing the holding clamp 32 with a greater elastic limit than that of tooth 30. In the preferred embodiment, the hardness of the clamp is less than the hardness of the tooth since they are designed to accomplish different functions.

All of the force acting between clamp surface 40 and tooth surface 60, and between tooth surface 62 and snout surface 22 is provided by the clamping force between clamp bearing surfaces 64 and snout surfaces 25. The holding engagement is enhanced by the increased ductility and/or elasticity of the clamp, as compared to the conventional devices, since this increased ductility or elasticity allows the clamp 32 to better "grab" or clamp onto the snout 21 by absorbing at least a portion of the wedging force between the clamp 32 and the snout 21. The metallic material of clamp 32 may have some ductility so as to actually deform slightly under anticipated clamping forces to assure contiguous mating contact between the bearing surfaces 25 (FIG. 3) and 64 (FIG. 8). However, such deformation is not necessary so long as at least some elasticity is provided by the clamp structure or the clamp material, e.g., the anticipated forces remain within the elastic limit of the clamp.

It will be observed that any axial forces along the z-axis exerted on the cutting edge 31 of the tooth 30 will be acting in the same direction required to move the clamp 32 into greater frictional engagement with the snout 21. In this regard, an aspect of the invention advantageously provides an arrangement wherein greater frictional contact area is provided between clamp 32 and tooth 30 than is provided between the tooth 30 and shank surface 22. In this manner, axial forces on tooth 30 act first to drive the clamp 32 into tighter wedging engagement as the tooth 30 and clamp 32 slide together over the shank surface 22, instead of the tooth sliding within the tooth receiving channel between the clamp 32 and shank surface 22. Alternatively, this feature may be provided by roughening or frictionally enhancing the clamp surface 40, as previously mentioned. Also, in accordance with an important aspect of the present invention, it is apparent that impacts by stones and the like on the front end 33 of the clamp 32 also act to move the clamp into closer frictional engagement with the cutting tooth 30 and the snout 21.

To release the clamp 32 for adjustment, reversal or replacement of the cutting tooth 30, it is merely necessary for a sharp blow to be delivered to the rear end 34 of clamp 32.

As will be observed, the reversible tooth 30 includes a mid-portion (excluding the cutting points) having a constant transverse cross-section which fits into a correspondingly-shaped tooth receiving channel of the U-shaped clamp 32. The internal structural configuration of the clamp 32 defines the boundaries of the receiving channel of constant transverse cross-section ending at the abutment surface 41 for engaging the midsection of the reversible tooth. Flat surfaces are preferred, but my invention is not limited thereto. Use of a bar stock tooth of constant transverse cross section without slippage in the constant cross sectional receiving channel is made possible by, inter alia, the self-tightening aspect of the invention, e.g., the differential frictional contact force. Thus, prior to engaging the clamp 32, the cutting tooth 30 can be adjusted forwardly or rearwardly within the channel of clamp 32 to the desired length since it advantageously comprises bar stock material of constant transverse cross section. Once the cutting tooth 30 has worn down to an extent requiring its extension, it can be extended merely by loosening the clamp 32, sliding the cutting tooth 30, and then re-tightening the clamp 32. Moreover, because the cutting tooth has essentially two cutting edges **31*a* and 31*b*, then once one edge has been worn down, the other end can be used as the new cutting edge simply by loosening the clamping assembly 32, sliding the tooth 30 forward until it clears the clamp body entirely, flipping the tooth 180° about the z-axis, reinserting the tooth 30 forwardly and retightening the clamp. The tooth may either be tightened at any position along the shank, or positioned so that the beveled surface 30*a* or 30*b* abuts the stopper wall 41** of the clamp.

Figure 10B:
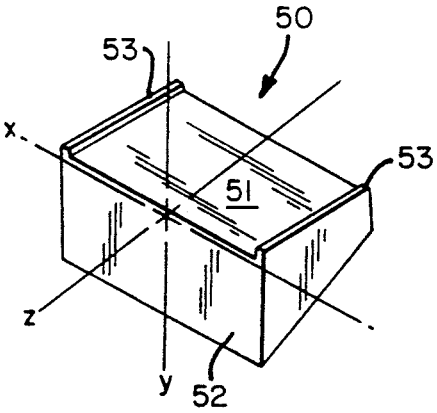
FIGS. 10A and 10B depict right and left perspective views of a protector block for use in the receiving channel of the clamp to protect the stopper wall and/or to extend the tooth relative to the clamp, as more particularly shown in FIG. 12B.
Figure 10A:
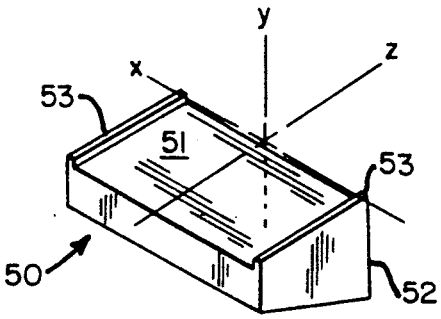
Figure 11:
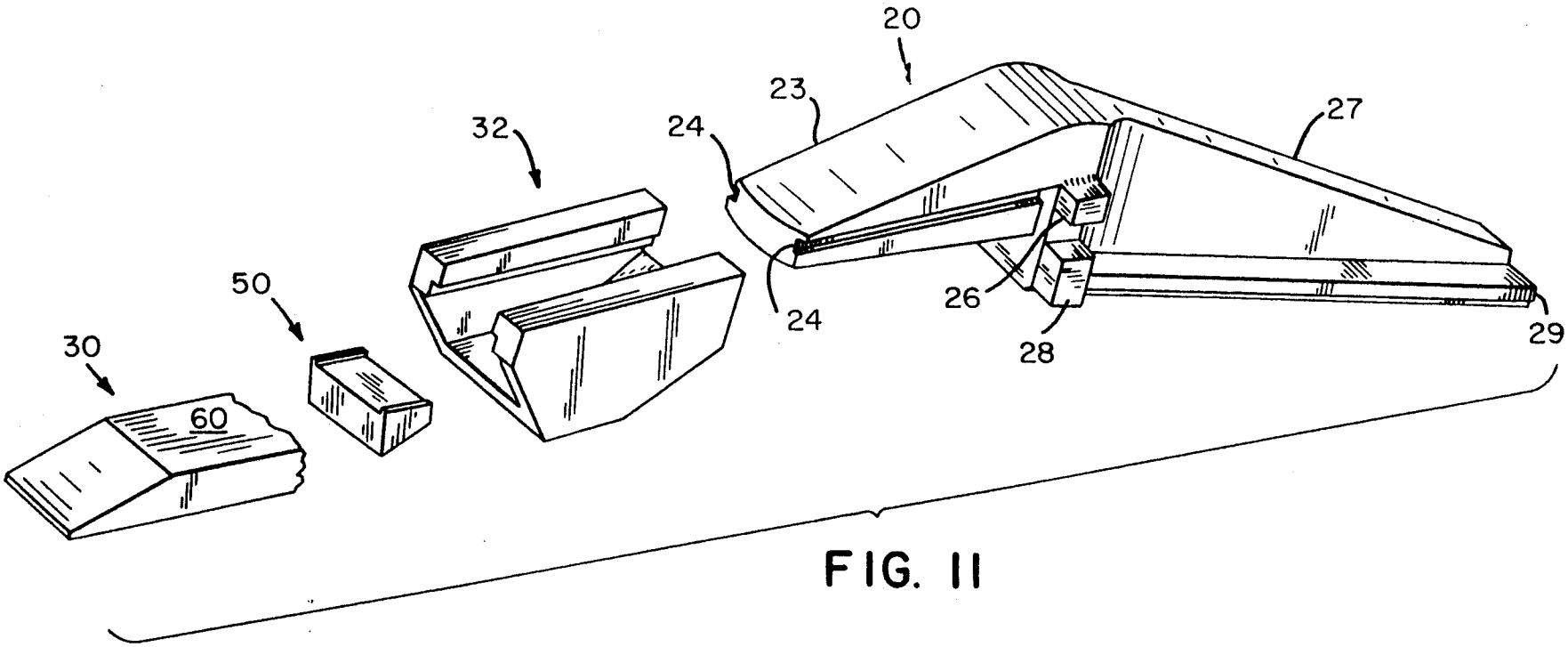
FIG. 11 is an exploded perspective view of an alternative embodiment of the invention shown in FIG. 1 and include the addition of the stopper block for extending a worn tooth.

FIGS. 10A, 10B and 11 depict alternative embodiments of the invention wherein a protector block 50 is inserted in the aft portion of the tooth receiving channel of the holding clamp 32. The primary purpose of the block 50 is to protect the stopper wall 41 in the tooth receiving channel from discontinuities of a worn tooth end, and to extend a badly worn tooth having no portion of the beveled cutting edge.

Figure 9:
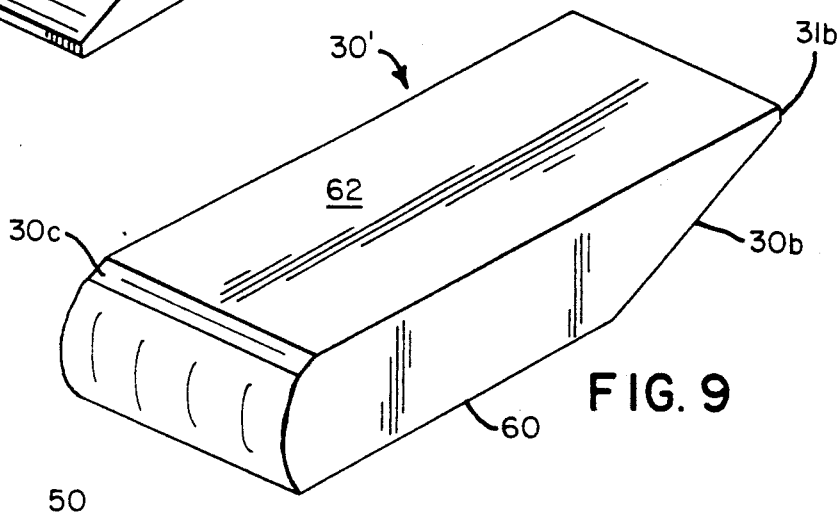
FIG. 9 depicts a worn tooth of FIG. 8.
Figure 12A:
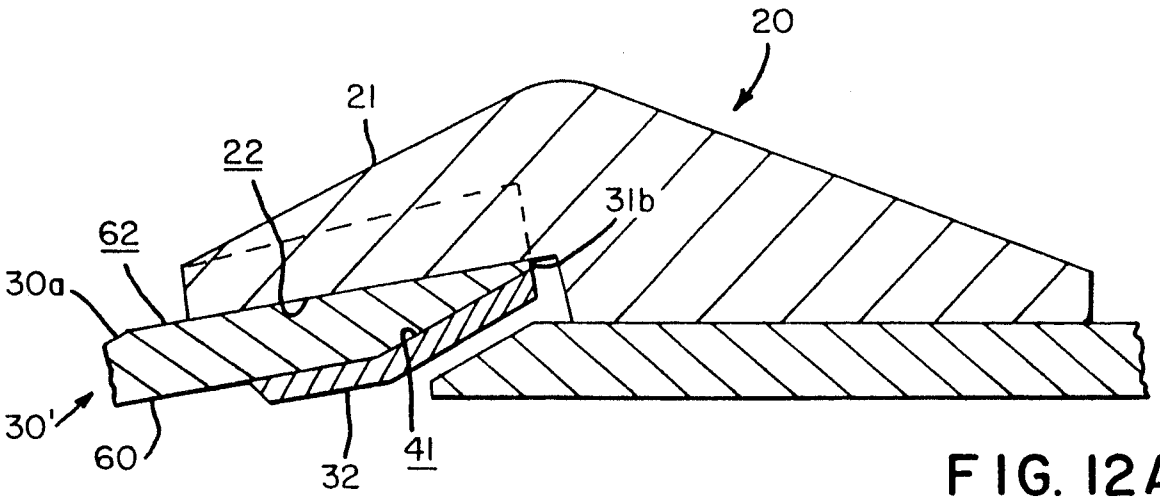
FIG. 12A depicts the assembly of FIG. 3, but having a worn tooth.

To explain, FIGS. 9 and 12A show worn teeth edges still having a portion **30*c* of the beveled cutting edge remaining. When reversed and inserted into the tooth channel as depicted in FIG. 12C, the beveled portion 30*c* abuts the stopper wall 41 of the clamp thereby to provide a positive stop against rearward motion of the tooth 30' without damaging the stopper wall. However, in the event that the machine operator permits substantial wear-down of the tooth where no portion of the beveled surface 30*a* remains, reversal and insertion of the extremely worn tooth could damage the stopper wall 41 since contact will most probably be discontinuous, and non-mating. To avoid such damage and to extend the substantially worn tooth, the protector block 50 of FIGS. 10A and 10**B is provided.

Figure 12B:
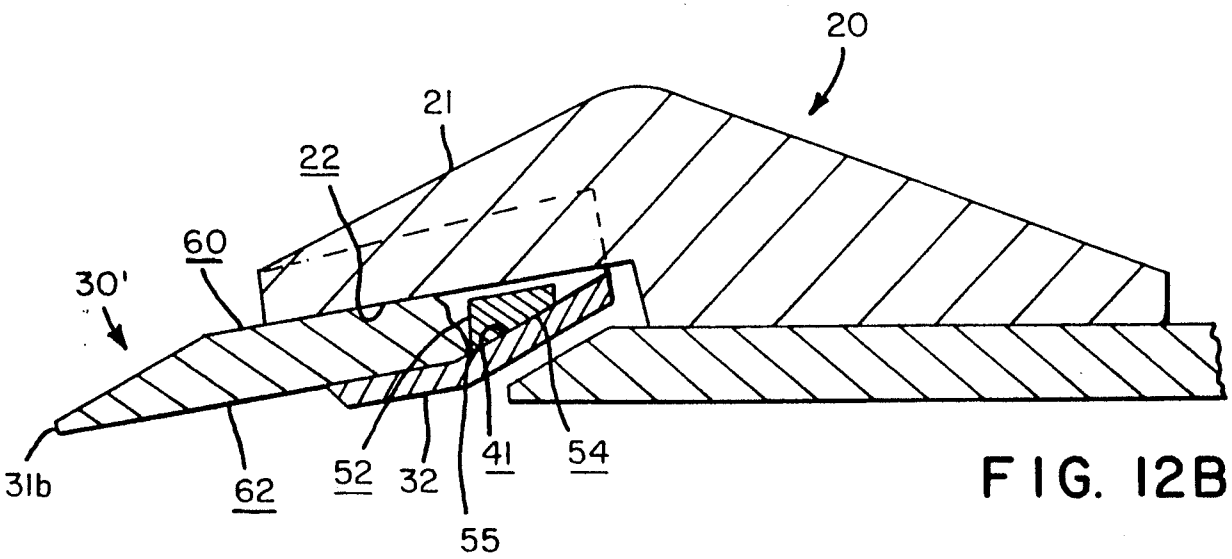
FIG. 12B depicts the assembly of FIG. 12A, but having the worn tooth reversed and the protector block of FIG. 10 inserted.
Figure 12C:
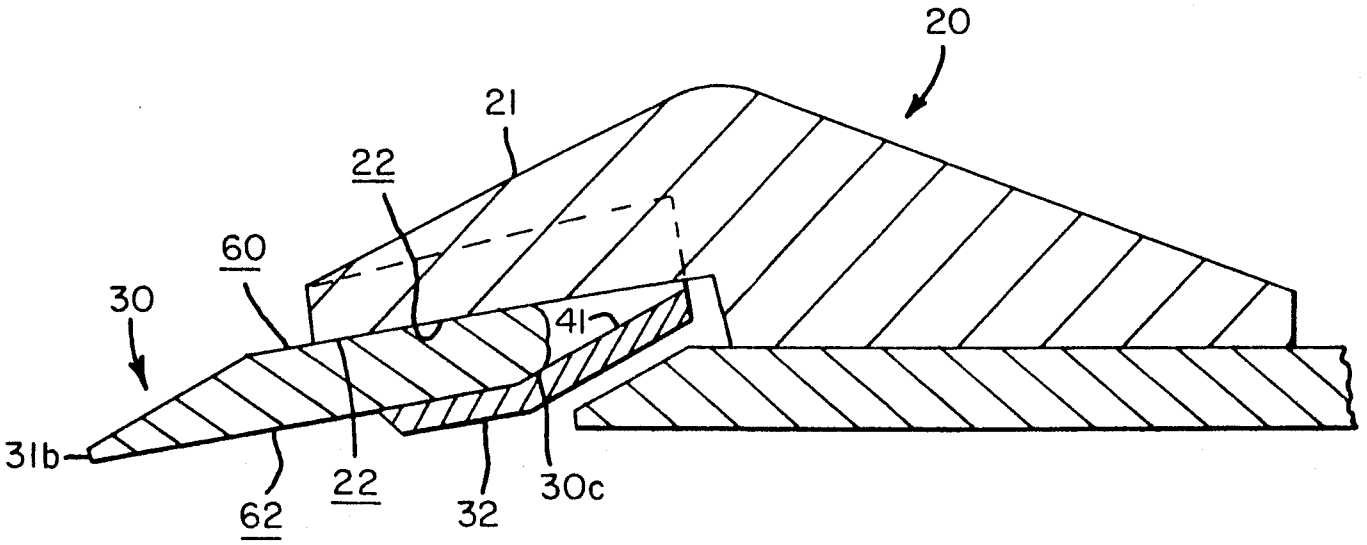
FIG. 12C depicts a worn tooth, holding clamp and shank in assembled relation wherein a bevel portion of the tooth remains on the worn tooth to abut against the stopper wall of the holding clamp.

The protector block 50 is designed to fit into the space between the stopper wall 41 and the worn tooth end, as shown in FIG. 12B, in order to prevent an acute angle of the worn tooth at junction 55 from bearing against the stopper wall 41. A tooth contact surface 52 of the protector block abuts the worn tooth edge while an inclined bottom surface 54 rests against at least a portion of the stopper wall 41. The contact surface 54 and stopper wall 41 have substantially the same incline relative to the z-axis when disposed in assembled relation.

As shown in the preferred embodiments of FIGS. 10B and 10B, the protector block 50 includes projecting ridges 53 on the top side so as to prevent its recessed surface 51 from contacting the snout surface 22. Contact between the surfaces 51 and 22 could undesirably interfere with clamping pressure between the tooth surface 60 snout surface 22. Instead, the ridges 53 engage the internal clamp surfaces 39 (FIG. 5) so as to insure clamp-to-tooth pressure in the event that debris enters the tooth receiving channel, which is typical in field operations. The block 50 is comprised of any hard material, preferably steel, but may be composed of composite, synthetic or natural materials.

In the alternative embodiment, axial forces exerted on the cutting edge 31 of the cutting tooth 30 will be transmitted directly to block 50, then to the clamp 32, and finally will act to force the clamp into further wedging engagement with the shank member 20, which in turn, applies a further y-axis force directly upon the tooth 30 thereby to achieve the self-tightening aspect of the present invention. Alternatively, self-tightening may be achieved by providing stops directly upon the tooth 30 as described in my prior U.S. Pat. No. 4,899,830, but not without some sacrifice of the tooth adjustability feature of the present invention.

Although one such block 50 is shown, it may constitute a spacer means comprising one or more different length spacer blocks. In this fashion, a worn tooth may be extended to a variety of positions as it wears down. The spacers may differ in length, the objective being to provide means to extend a worn tooth but yet retain a sufficient surface contact area between the clamp, tooth and shank. The spacer blocks are thinner and/or narrower than the cutting tooth 30 so as not to interfere with the frictional engagement of the cutting tooth 30, clamp 32 and snout 21.

Even though there is a smaller area of frictional engagement between the cutting tooth 30, clamp 32 and snout 21 as the cutting tooth 30 is extended from the receiving channel, the cutting tooth 30 will still be held in place since the clamping force will be concentrated in this area. Therefore, the clamping pressure will be higher as it is applied to a smaller engagement area, maintaining the cutting tooth 30 in place. An engagement between the cutting tooth 30 and the clamp 32 of approximately twenty-five millimeters is all that is required in most applications to properly hold the cutting tooth 30 in place when the clamp 32 is clamped down. Eventually, there will be an insufficient length left of the cutting tooth 30 for it to be adequately clamped by the clamp 32. At this point, it is necessary to replace the cutting tooth 30.

While various embodiments of the invention have been described in accordance with what is presently conceived to be the most practical and preferred embodiment, it is to be understood that the invention is not to be limited to the disclosed embodiments, but on the contrary, is intended to cover various modifications and equivalent arrangements included within the spirit and the scope of the appended claims, which scope is to be accorded the broadest interpretation of such claims so as to encompass all such equivalent structures. For example, the clamp need not necessarily be U-shaped and its resiliency may be attained in several ways without departing from the spirit of my invention. The respective lengths of the receiving channels may vary or even be segmented so as to achieve the same result in the same way. Resiliency in holding force may be provided by the stress-strain characteristics of the clamp material or by a spring effect attained by the physical structure of the clamp, e.g., by specially designing the flange, legs or mid-section of the clamp. The differential tooth-to-clamp and tooth-to-shank frictional holding forces may be attained by different amounts of surface area contact, or by differential frictional properties between the respective surfaces. The cross sectional areas of the tooth and clamp receiving channel may take on a variety of forms other than rectangular. Adaptors and spacers may be utilized in a variety of ways without departing from the spirit of my invention. Alternative shank designs may also be utilized. Relative hardness, elasticity, and ductility qualities of the tooth and clamp material may vary from illustrated values, depending upon the application to which the tooth is put. Although metal is commonly used for such materials, my invention is not limited thereto, but is intended to embrace composites, plastics and other suitable materials to achieve resilient self-clamping and abrasive cutting. Accordingly, it is my intent to include all such modifications and adaptations as may come to those skilled in the art.

What is desired to be secured by United States Letters Patent is:

1. A boltless holding clamp for frictionally clamping a reversible cutting tooth upon a digging member shank of an earth working machine, said tooth having a constant transverse cross section and cutting points at each end thereof, said clamp comprising:

a body of material having appending flanges for interlocking with locking grooves of said shank, means for defining a receiving channel of constant transverse cross section for receiving said reversible tooth, means for self-tightening said tooth against said shank in response to axial load forces applied to said tooth, and stopper wall means in the rear portion of said receiving channel for mating with one of said cutting points of said reversible cutting tooth.

2. A boltless holding clamp as recited in claim 1 wherein said stopper wall means in said receiving channel is complementary to the shape of said cutting points.

3. In combination, a boltless holding clamp as recited in claim 1, and a reversible cutting tooth of constant transverse cross section wherein said tooth comprises a hardened, wear-resistant material of constant transverse cross section having respective cutting points formed at two ends thereof.

4. The invention as recited in claim 1 wherein said receiving channel includes protector block means for adjustably extending said tooth having a worn end thereof inserted into said receiving channel.

5. The invention as recited in claim 4 wherein said protector block means is inserted between said stopper wall means and the worn end of said tooth to axially extend the tooth from the holding clamp by a length of the spacer block means, the cross sectional area of the protector block means being smaller than the cross sectional area of the cutting tooth so as not to interfere with the clamping of the cutting tooth to the shank during clamping engagement.

6. A boltless holding clamp for clamping a reversible cutting 10 tooth including a portion of constant transverse cross section at adjustable positions along a shank of a digging member of an earth working machine, said clamp comprising:

a generally U-shaped body of material having appending flanges for interlocking with locking grooves of said shank, means for defining a receiving channel of constant transverse cross section for receiving said reversible tooth at adjustable axial positions therein, differential friction means for self-tightening said reversible tooth against said shank in response to axial load forces applied to said tooth, stopper wall means in the rear portion of said receiving channel for engaging said tooth when fully inserted therein, and resiliency means for absorbing vibrations in clamping force between said tooth and shank.

7. The invention as recited in claim 6 wherein the clamping force provided by said resiliency means is defined by a predetermined stress-strain characteristic of said generally U-shaped body of material.

8. The invention as recited in claim 6 wherein said resiliency means produces a spring effect defined by the physical structure of said generally U-shaped body of material.

9. In combination, a boltless holding clamp as recited in claim 6 and a reversible cutting tooth comprising a hardened, wear-resistant material formed from elongated material having respective cutting points formed at each end thereof.

10. The invention as recited in claim 6 wherein said receiving channel includes protector block means for adjustably extending said tooth.

11. The invention as recited in claim 10 wherein said protector block means is inserted between the stopper wall means and a worn end of the tooth to axially extend the tooth from the holding clamp by a length of the spacer block means, the cross sectional area of the spacer block means being smaller than the cross sectional area of the cutting tooth so as not to interfere with the clamping of the cutting tooth to the shank during clamping engagement.

12. A boltless cutting tooth assembly for use in an earth working machine having a digging member for providing adjustable clamping of a reversible cutting tooth of constant transverse cross section at adjustable positions along a shank of said digging member, said assembly comprising:

A. a shank connected to the digging member, said shank including at least one locking groove providing an inclined wedge-locking bearing surface;

B. a generally U-shaped holding clamp which couples the tooth to said shank by providing a tooth-to-shank frictional contact force, said clamp including:

i. a receiving channel of uniform cross section for supporting said tooth in axial alignment, said receiving channel including:

a. a friction surface which bears against a flat surface of said tooth when engaged in said receiving channel to define a clamp-to-tooth frictional contact force, b. side walls for guiding and preventing lateral displacement of said tooth in said receiving channel, ii. appending flanges which include bearing surface means for engaging locking grooves of said shank and for translating substantially all of said wedging force to said clamp-to-tooth frictional contact force whereby to prevent vertical displacement of said tooth and holder when clamped together, said clamp comprising a ductile material adapted for absorbing at least a portion of the wedging force when placed in wedging engagement with said shank whereby to reduce loosening of the tooth during vibrational loading conditions, and C. said reversible tooth comprising an elongated, hardened bar stock material of constant cross section and including a first bearing surface which bears against the friction surface of the clamp and a second bearing surface which bears against said shank when held in clamping relationship, said tooth including a cutting point formed at each end thereof.

13. A boltless cutting tooth assembly as recited in claim 12 wherein the clamp-to-tooth frictional contact force exceeds the tooth-to-shank frictional contact force whereby axial loads upon the tooth act first to drive the clamp into greater clamping relation before the tooth axially slides upon said shank.

14. A boltless cutting tooth assembly as recited in claim 12 wherein the width of the cutting tooth is greater than the thickness of said shank whereby to provide greater tooth-to-clamp frictional contact.

15. A boltless cutting tooth assembly as recited in claim 12 wherein said cutting tooth comprises a hardened wear-resistant material having a rectangular cross sectional area.

16. A boltless cutting tooth assembly as recited in claim 12, wherein the holding clamp further comprises at least one spacer block means extending into a rear portion of the receiving channel to limit axial displacement of a worn tooth in the channel.

17. A boltless holding clamp adapted for coupling locking grooves of a shank member of an earth working machine, said clamp developing a shank-to-clamp wedging force when positioned in clamping engagement and comprising:

A. a generally U-shaped body of material having a predetermined stress-strain characteristic for providing a resilient holding force and being adapted for translating substantially all of said shank-to-clamp wedging force to a clamp-to-tooth and tooth-to-shank frictional contact force for holding a reversible cutting tooth having cutting points formed at each end thereof, said U-shaped body including:

i. a pair of appending flange means for engaging said locking grooves of said shank member and for defining a first receiving channel for receiving a portion of said shank member between said pair of appending flange means, ii. said flange means further including an inclined bearing surface for bearing against the locking grooves of said shank when axially positioned onto said shank, iii. a second receiving channel means of uniform cross section defined by said U-shaped body and said shank member for receiving a cutting tooth also of uniform cross section in axial alignment within said second receiving channel, said second receiving channel further including friction surface means for bearing against said cutting tooth when positioned in said second receiving channel in clamping engagement and a pair of side walls for restraining lateral displacement of said tooth when positioned in said receiving channel, and iv. stopper wall means in said receiving channel having a complementary surface for engaging a complementary surface of each of said cutting points of said reversible tooth.

18. A boltless holding clamp adapted for coupling locking grooves of a shank member of an earth working machine, said clamp developing a shank-to clamp wedging force when positioned in clamping engagement upon said shank, said clamp comprising:

A. a generally U-shaped body of material having a predetermined modulus of elasticity for providing a resilient holding force and being adapted for translating substantially all of said shank-to-clamp wedging force to a clamp-to-tooth and tooth-to-shank frictional contact force for holding a cutting tooth, said U-shaped body including:

i. a pair of appending flange means for engaging said locking grooves of said shank member and for defining a T-shaped receiving channel for receiving a portion of said shank member between said pair of appending flange means, ii. said flange means further including an inclined bearing surface for bearing against the locking grooves of said shank when axially positioned onto said shank, iii. a second receiving channel means of uniform transverse cross section defined by said U-shaped body and said shank member for receiving a reversible cutting tooth in axial alignment within said second receiving channel wherein said tooth also has a uniform transverse cross section and beveled cutting points formed at each end thereof, said second receiving channel further including friction surface means for bearing against said cutting tooth when positioned in said second receiving channel in clamping engagement and a pair of side walls for restraining lateral displacement of said tooth when positioned in said receiving channel, and iv. stopper wall means in said receiving channel having a complementary surface for engaging a complementary surface of each of said cutting points of said reversible tooth.

* * * * *